US006825822B2

(12) United States Patent
Lee

(10) Patent No.: US 6,825,822 B2
(45) Date of Patent: Nov. 30, 2004

(54) DISPLAY APPARATUS WITH A TIME DOMAIN MULTIPLEX DRIVING CIRCUIT

(75) Inventor: Hsin-Ta Lee, Taoyuan (TW)

(73) Assignee: Chei Mei Optoelectronics Corp. (TW)

( * ) Notice: Subject to any disclaimer, the term of this patent is extended or adjusted under 35 U.S.C. 154(b) by 294 days.

(21) Appl. No.: 10/212,124

(22) Filed: Aug. 6, 2002

(65) Prior Publication Data

US 2003/0030609 A1 Feb. 13, 2003

(30) Foreign Application Priority Data

Aug. 9, 2001 (TW) ..... 90119364 A

(51) Int. Cl.[7] ..... G09G 3/36
(52) U.S. Cl. ..... 345/87; 345/92
(58) Field of Search ..... 345/87, 88, 89, 345/90, 92, 93, 98, 99, 103; 349/33, 36, 41, 42, 48

(56) References Cited

U.S. PATENT DOCUMENTS 4,781,438 A * 11/1988 Noguchi ..... 349/54
5,453,857 A * 9/1995 Takahara ..... 349/48
5,844,535 A * 12/1998 Itoh et al. ..... 345/92
6,417,825 B1 * 7/2002 Stewart et al. ..... 345/77
2001/0017610 A1 * 8/2001 Ozawa ..... 345/100
2001/0024186 A1 * 9/2001 Kane et al. ..... 345/98
2002/0005825 A1 * 1/2002 Lee et al. ..... 345/76
2002/0044124 A1 * 4/2002 Yamazaki et al. ..... 345/92
2002/0149553 A1 * 10/2002 Tsujimura et al. ..... 345/92
2003/0160751 A1 * 8/2003 Kudo et al. ..... 345/89

* cited by examiner

*Primary Examiner*—Amare Mengistu
*Assistant Examiner*—Nitin Patel
(74) *Attorney, Agent, or Firm*—Rabin & Berdo, P.C.

(57) ABSTRACT

A display apparatus comprising first, second, and third scan lines in parallel, first data line perpendicular to the scan lines, first pixel coupled to the first data line, the first scan line, and the second scan line respectively, a second pixel coupled to the first data line and the first scan line respectively, a third pixel coupled to the first data line and the second scan line respectively, and a fourth pixel coupled to the first data line, the second scan line, and the third scan line respectively. The first pixel and the third pixel are on the same side of the first data line and the second pixel and the fourth pixel are on the other side of the first data line.

26 Claims, 8 Drawing Sheets

DISPLAY APPARATUS WITH A TIME DOMAIN MULTIPLEX DRIVING CIRCUIT

This application incorporates by reference of Taiwan application Serial No. 090119364, filed Aug. 9, 2001.

BACKGROUND OF THE INVENTION

1. Field of the Invention

The invention relates in general to a display apparatus, and more particularly to a display apparatus with a time domain multiplex driving circuit.

2. Description of the Related Art

Featuring the favorable properties of thinness, lightness and generating low radiation, Liquid Crystal Display (LCDs) have been widely used in the world.

FIG. 1 shows a circuit diagram illustrating a conventional LCD panel. The display panel includes a plurality of pixels (P). The pixels are arranged in the form of a matrix on the display panel. The display panel includes an active matrix driving circuit for driving the pixels. The active matrix driving circuit includes a plurality of scan lines (S), a plurality of data lines (D), and a plurality of switching devices. The switching devices are set in the pixels for selectively transmitting the corresponding data signals to the pixels. The switching device can be a thin film transistor (TFT) such as an n-type field effect transistor (n-FET) or a p-type field effect transistor (p-FET). In FIG. 1, the switching device of each pixel includes a thin film transistor. The thin film transistor in each pixel includes a gate electrode, a first source/drain electrode, and a second source/drain electrode. The gate electrode of the thin film transistor is coupled to the corresponding scan line and the first source/drain electrode is coupled to the corresponding data line. Take the pixel P(m,n) for example. The pixel P(m,n) includes a thin film transistor M1. The gate electrode of the thin film transistor M1 is coupled to the scan line $S_m$, and the first source/drain electrode of the thin film transistor M1 is coupled to the data line $D_n$. Each scan line is perpendicular to each data line. Each pixel in the same pixel row is coupled to the same scan line and each pixel in the same pixel column is coupled to the same data line, as shown in FIG. 1.

FIG. 2 shows the configuration of a conventional active matrix liquid crystal display. The conventional active matrix liquid crystal display includes a display panel 202, an X board 214, and a Y board 212. The display panel 202 includes the pixels and the active matrix driving circuit, as shown in FIG. 1. The X board 214 is coupled to a plurality of scan drivers 206 set in the tape carrier packages 210. Each scan driver 206 is coupled to the X board 214 and the corresponding scan lines respectively. The Y board 212 is coupled to a plurality of data drivers 204 set in the tape carrier packages (TCP) 208. Each data driver 204 is coupled to the Y board 212 and the corresponding data lines respectively. The X board 214 and the scan drivers 206 are used for enabling the corresponding scan lines through inputting a scan signal into the scan line. When the scan line is enabled, each pixel in the pixel row coupled to the scan line can be turned ON. The Y board 212 and the data drivers 204 are used for inputting the data signals to the corresponding pixels through the corresponding data lines when the pixels are turned ON.

The conventional active matrix liquid crystal display has the following disadvantages. First, a large number of data lines are needed. For example, an active matrix display panel has a resolution of 1024×768, that is, the active matrix display panel having 1024 pixel columns and each pixel column having 1024×3=3072 pixels. Therefore, the active matrix display panel must include 3072 data lines. The number of the data lines is large. Besides, since there are so many data lines are needed, the pitch between the adjacent data lines must be small. Second, each data line is coupled to the corresponding data driver through the outer lead of the tape carrier package. It is difficult and elaborate to connect all data lines to the corresponding outer leads of the tape carrier packages. Third, the aperture ratio of the display panel will be decreased since the number of the data lines is so large.

FIG. 3 shows the diagram of the conventional time domain multiplex driving circuit. In the conventional time domain multiplex driving circuit, every two adjacent pixels in the same pixel row are coupled to the same data line. These two pixels are set on the left and right sides of the data line respectively. The pixel set on the left side of the data line is called the left pixel (LP) and the pixel set on the right side of the data line is called the right pixel (RP). The switching devices of the pixels LP and RP are different. Take the pixels LP(m,n) and RP(m,n) as an example. These two pixels are coupled to both the same scan line $S_m$ and the same data line $D_n$. The pixel LP(m,n) is set on the left side of the data line $D_n$ and the pixel RP(m,n) is set on the right side of the data line $D_n$, as shown in FIG. 3. The switching device of the pixel RP(m,n) includes a thin film transistor M2. The gate electrode of the thin film transistor M2 is coupled to the scan line $S_m$ and the first source/drain electrode of the thin film transistor M2 is coupled to the data line $D_n$. The switching device of the pixel LP(m,n) is different from that of the pixel RP(m,n). The switching device of the pixel LP(m,n) includes two thin film transistors M11 and M12. The gate electrode of the thin film transistor M11 is coupled to the scan line $S_{m+1}$ and the first source/drain electrode of the thin film transistor M11 is coupled to the data line $D_n$. The gate electrode of the thin film transistor M12 is coupled to the scan line $S_m$ and the first source/drain electrode of the thin film transistor M12 is coupled to the second source/drain electrode of the thin film transistor M11, as shown in FIG. 3.

FIG. 4 shows the timing chart of the scan signals of the scan lines $S_m$, $S_{m+1}$, and $S_{m+2}$ and the ON and OFF status of the corresponding pixels LP(m,n), RP(m,n), LP(m+1,n), and RP(m+1,n) shown in FIG. 3. The method for driving display panel with the above-described time domain multiplex driving circuit is called a time domain multiplex driving method. When the time domain multiplex driving method is executed, each pixel row is driven in turn by the time domain multiplex driving circuit. The time domain multiplex driving method includes two scanning procedures. The first scanning procedure is to selectively turn on the left pixels of the pixel row by turning on two corresponding TFTs of each of the left pixels and then feeding the corresponding data signals into the respective left pixels. The second scanning procedure is to selectively turn on the right pixels of the pixel row by turning on one corresponding TFT of each right pixel and then feeding the corresponding data signals into the respective right pixels.

Take pixels LP(m,n) and RP(m,n) shown in FIG. 3 as an example. In the time period T1, the scan line $S_m$ and $S_{m+1}$ are enabled. The thin film transistor M11 and M12 can be turned ON and a data signal can be inputted to the corresponding pixel LP(m,n) through the TFTs M11 and M12. In the time period T2, only the scan line $S_m$ is enabled. The thin film transistor M2 can be turned ON and a data signal can be inputted to the corresponding pixel RP(m,n) through the TFT M2.

In the time domain multiplex driving circuit, the above-described disadvantages of the conventional active matrix driving circuit can be improved. If the resolution of the display panel is 1024×768, for example, every two adjacent pixels in the same pixel row are coupled to one corresponding data line of the time domain multiplex driving circuit, and thus only 3072/2=1536 data lines are needed.

However, the conventional time domain multiplex driving circuit disclosed above has the following disadvantages. First, an equivalent resistor $R_o$ is produced between the first source/drain electrode and the second source/drain electrode when the thin film transistor is turned on. The driving time needed to input the data signal into the corresponding pixel may be affected by the equivalent resistor $R_o$ of the thin film transistor. The larger the resistance of the resistor $R_o$ is, the more the driving time is needed to drive the pixels. In FIG. 1, the switching device of the pixel P(m,n) includes only one thin film transistor M1. Thus, the equivalent resistor of the pixel P(m,n) shown in FIG. 1 is $R_o$. In FIG. 3, the pixel LP(m,n) includes two thin film transistors M11 and M12. The data signal must pass through both of the thin film transistors M11 and M12 to get into the pixel LP(m,n). Therefore, the equivalent resistor of the pixel LP(m,n) shown in FIG. 3 is $2R_o$, two times that of the pixel P(m,n) shown in FIG. 1. When the pixels are driven by the time domain multiplex driving circuit, the driving time needed to input all data signals into the corresponding pixels must be longer.

Second, an equivalent capacitor between the gate electrode and the second source/drain electrode is produced when the thin film transistor is turned ON. The output voltage will be lower than the input voltage of the thin film transistor and the luminance of the pixel may be decreased because of the equivalent capacitor. This effect caused by the equivalent capacitor is called the feed-through effect. The larger the capacitance of the equivalent capacitor is, the larger the difference between the output voltage and the input voltage of the thin film transistor is. Take the pixels LP(m,n) and RP(m,n) shown in FIG. 3 as an example. The switching device of the pixel RP(m,n) includes only one thin film transistor M2 and the switching device of the pixel LP(m,n) includes two thin film transistors M11 and M12. The data signal inputted to the pixel RP(m,n) only through the thin film transistors M2 but the data signal inputted to the pixel LP(m,n) through two thin film transistors, M11 and M12. Therefore, the equivalent capacitor of LP(m,n) is much larger than that of RP(m,n). During driving the pixels by the time domain multiplex driving circuit, the luminance of the pixel LP(m,n) will be smaller than that of the pixel RP(m,n) when the data signals inputted to the pixel LP(m,n) and RP(m,n) are of the same magnitude. The display performance of the liquid crystal display would thus be degraded.

Third, the luminance of a display panel whose pixels are arranged according to the structure shown in FIG. 3 would be non-uniform when identical data signals are applied to all pixels of the display. This phenomenon is called odd-even line. For the display panel according to FIG. 3, each pixel of the odd (or even) pixel columns includes two TFTs and each pixel of the even (or odd) pixel columns includes one TFT, so that the equivalent capacitances of the adjacent pixel columns are different, thus resulting in the non-uniformity of luminance. The display quality of the liquid crystal display may be degraded because of the odd-even line problem.

According to the foregoing descriptions, the conventional time domain multiplex driving circuit has the following disadvantages. First, the driving time needed to input the data signals into the corresponding pixels must be longer. Second, the display performance may be degraded. Third, the odd-even line problem may happen.

SUMMARY OF THE INVENTION

It is therefore an objective of the present invention to provide a display apparatus with a new time domain multiplex driving circuit for driving the pixels of the display apparatus so as to achieve the objectives: First, the number of the data lines can be decreased. Second, it takes less driving time to input the data signals into the corresponding pixels. Third, the display performance of the display panel cannot be affected.

According to the objectives of the present invention, it is provided a display apparatus comprising a first, a second, and a third in parallel scan lines, a first data line perpendicular to the scan lines, a first pixel coupled to the first data line, the first scan line and the second scan line respectively, a second pixel coupled to the first data line and the first scan line respectively, a third pixel coupled to the first data line and the second scan line respectively, and a fourth pixel coupled to the first data line, the second scan line and the third scan line respectively. The first pixel and the third pixel are on the same side of the first data line and the second pixel and the fourth pixel are on the other side of the first data line.

Other objects, features, and advantages of the invention will become apparent from the following detailed description of the preferred but non-limiting embodiments. The following description is made with reference to the accompanying drawings.

DETAILED DESCRIPTION OF PREFERRED EMBODIMENTS

The feature of the present invention is to provide the new switching device structure of the time domain multiplex driving circuit. According to the invention, the disadvantages of the conventional time domain multiplex driving circuit can be improved.

First Embodiment

Figure 5:
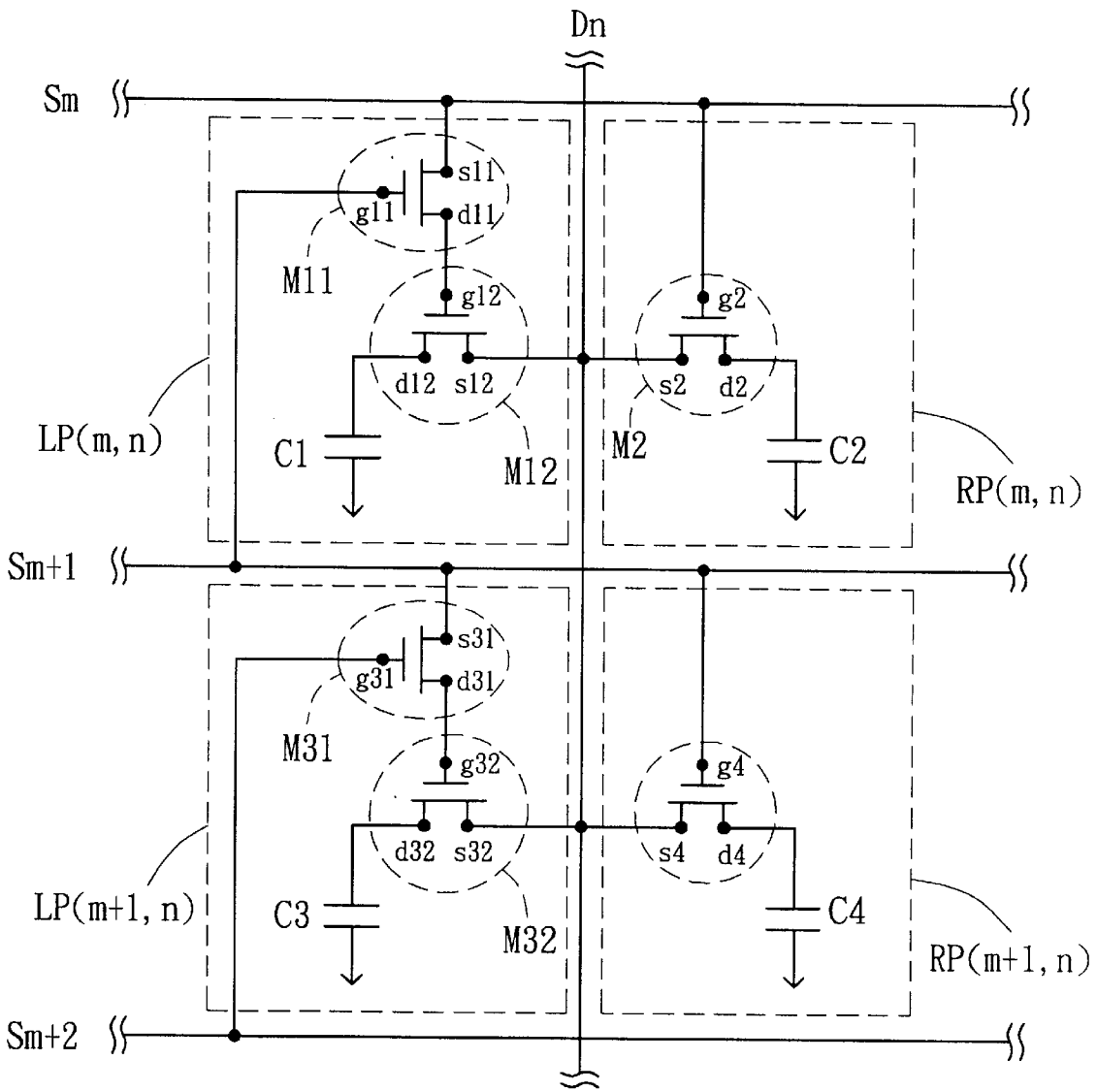
FIG. 5 shows a diagram of the time domain multiplex driving circuit according to a first embodiment of the present invention.

FIG. 5 shows a diagram of the time domain multiplex driving circuit according to a first embodiment of the present invention. Take the pixel LP(m,n) and RP(m,n) shown in FIG. 5 for example; these two pixels are coupled to both the same scan line $S_m$ and the same data line $D_n$. The pixel LP(m,n) is set on the left side of the data line $D_n$ and the pixel RP(m,n) is set on the right side of the data line $D_n$, as shown in FIG. 5. The switching device of the pixel RP(m,n) includes a switch M2 which is used for selectively transmitting the data signal loaded on the data line $D_n$ to the pixel RP(m,n). The switching device of the pixel LP(m,n) includes two switches M11 and M12 which are used for selectively transmitting the data signal on the data line $D_n$ to the pixel LP(m,n). It should be noticed that all the switches can be thin film transistors and the pixel with two switches (i.e. LP(m,n)) can be set on the right side of the data line and the pixel with only one switch (i.e. RP(m,n)) can then be set on the left side of the data line.

The switching device of the pixel RP(m,n) includes a thin film transistor M2. The gate electrode of the thin film transistor M2 (g2) is coupled to the scan line $S_m$ and the source electrode of the thin film transistor M2 (s2) is coupled to the data line $D_n$ respectively. The switching device of the pixel LP(m,n) is different from that of the pixel RP(m,n). The switching device of the pixel LP(m,n) includes two thin film transistors M11 and M12. The gate electrode of the thin film transistor M11 (g11) is coupled to the scan line $S_{m+1}$ and the source electrode of the thin film transistor M11 (s11) is coupled to the scan line $S_m$. The source electrode (s12) and the gate electrode (g12) of the thin film transistor M12 are coupled to the data line $D_n$ and the drain electrode of the thin film transistor M11 (d11) respectively, as shown in FIG. 5.

Figure 1:
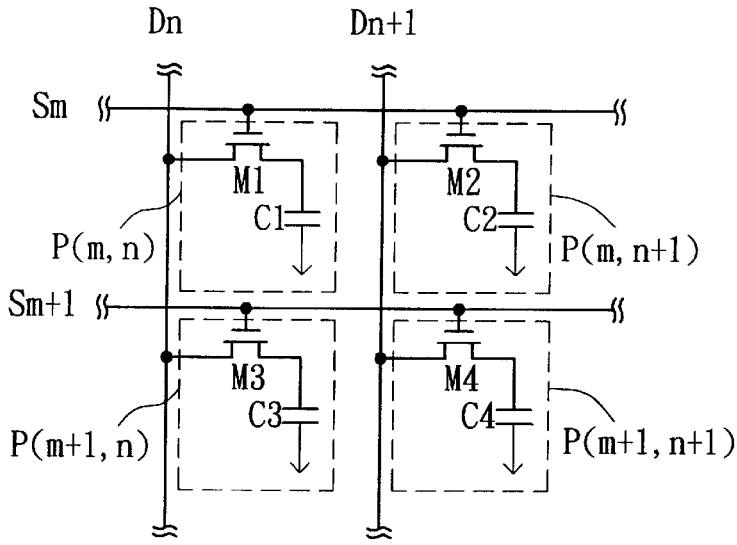
FIG. 1 (PRIOR ART)
FIG. 1 shows a circuit diagram illustrating a conventional liquid crystal display panel.
Figure 2:
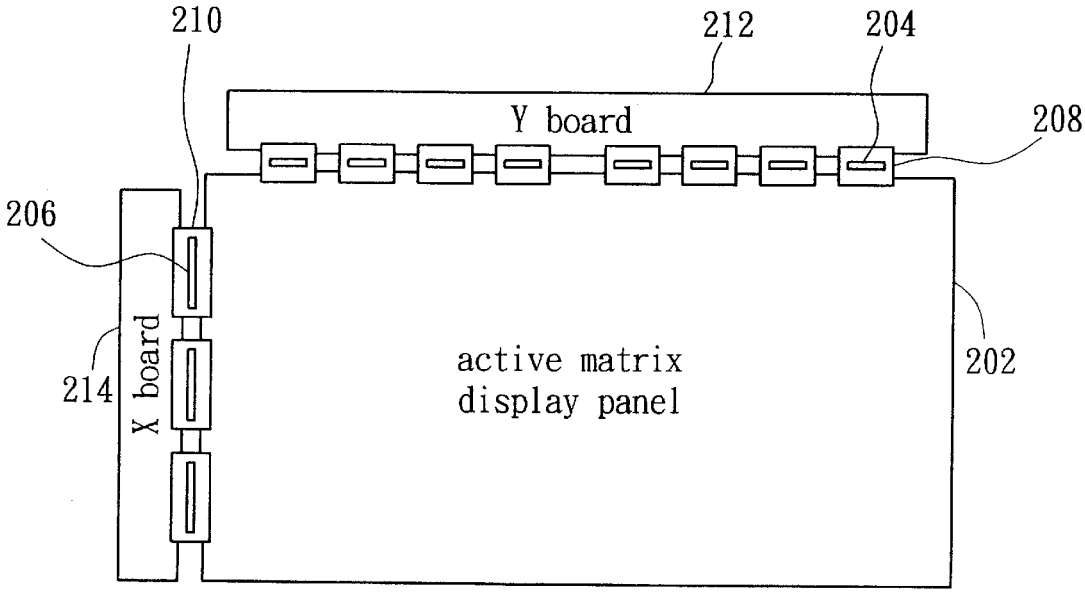
FIG. 2 (PRIOR ART)
FIG. 2 shows the configuration of a conventional active matrix liquid crystal display.
Figure 3:
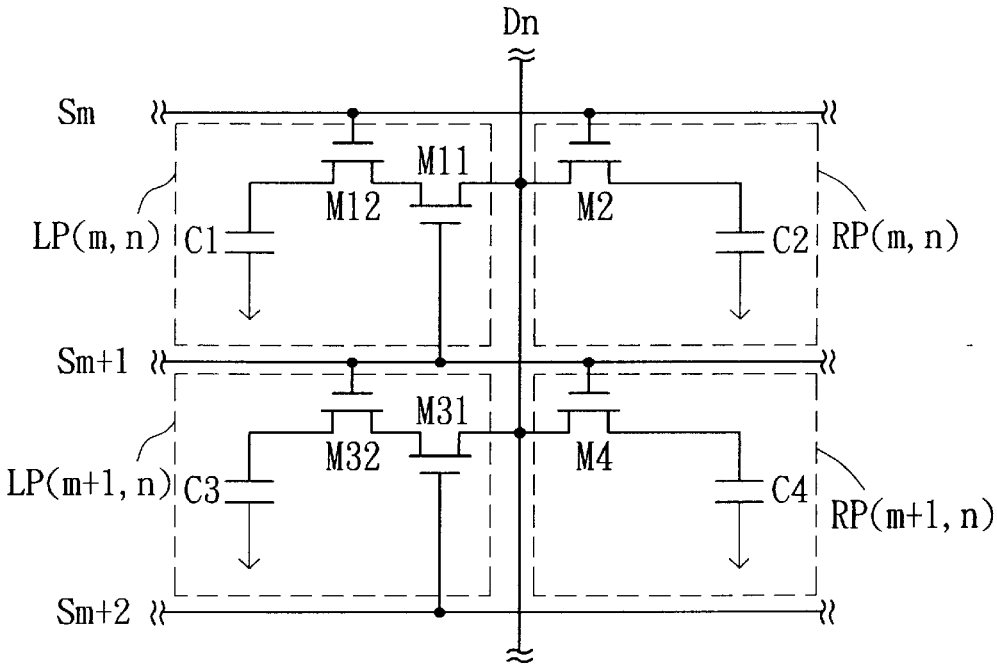
FIG. 3 (PRIOR ART)
FIG. 3 illustrates a conventional time domain multiplex driving circuit.
Figure 4:
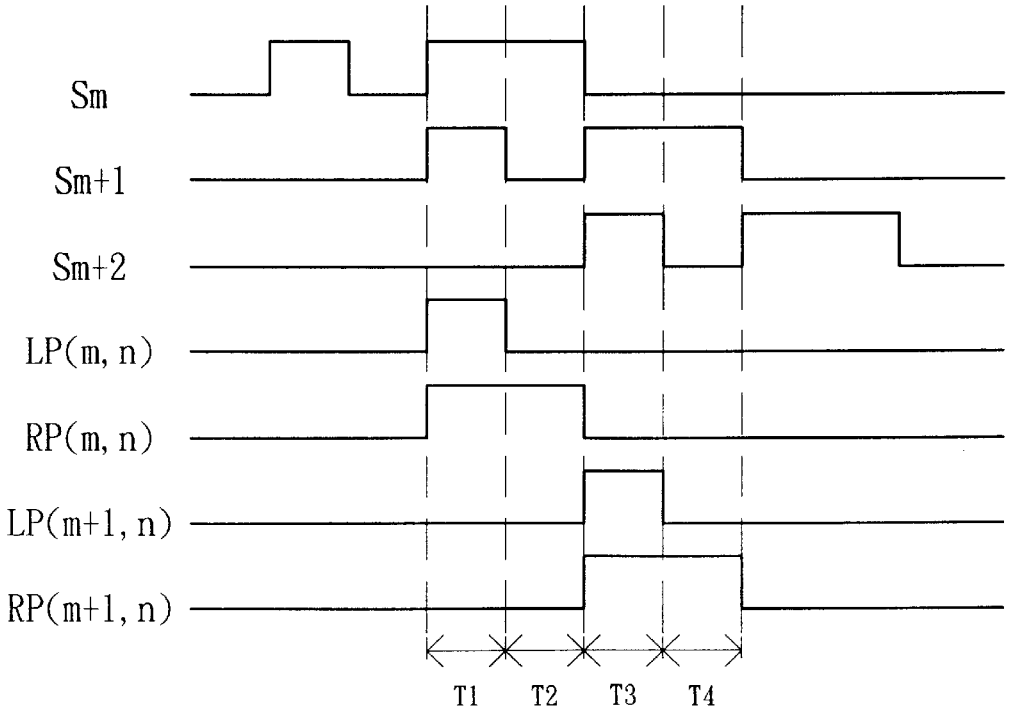
FIG. 4 (PRIOR ART)
FIG. 4 shows a timing chart of the scan signals of the scan line $S_m$, $S_{m+1}$, and $S_{m+2}$ and the ON and OFF status of the corresponding pixels LP(m,n), RP(m,n), LP(m+1,n), and RP(m+1,n) shown in FIG. 3.

The switching device of the time domain multiplex driving circuit of the present invention is different from that of the conventional time domain multiplex driving circuit. Take pixel LP(m,n) shown in FIG. 3 and the pixel LP(m,n) shown in FIG. 5 for example. Both the pixel LP(m,n) shown in FIG. 3 and the pixel LP(m,n) shown in FIG. 5 include two corresponding thin film transistors. In FIG. 3, the gate electrode of the thin film transistors M11 (g11) and M12 (g12) are coupled to the scan lines $S_{m+1}$ and $S_m$ respectively. Therefore, the thin film transistors M11 can be turned ON by enabling scan line $S_{m+1}$ directly and the thin film transistor M12 can be turned ON by enabling scan line $S_m$ directly. The ON and OFF status of the thin film transistor cannot be controlled by the other thin film transistor. In FIG. 5, the gate electrode of the thin film transistor M12 (g12) is coupled to the drain electrode of the thin film transistor M11 (d11). Therefore, the ON and OFF status of the thin film transistor M12 can be controlled by the thin film transistor M11. The thin film transistor M12 cannot be turned ON unless the thin film transistor M11 is turned ON.

Figure 6:
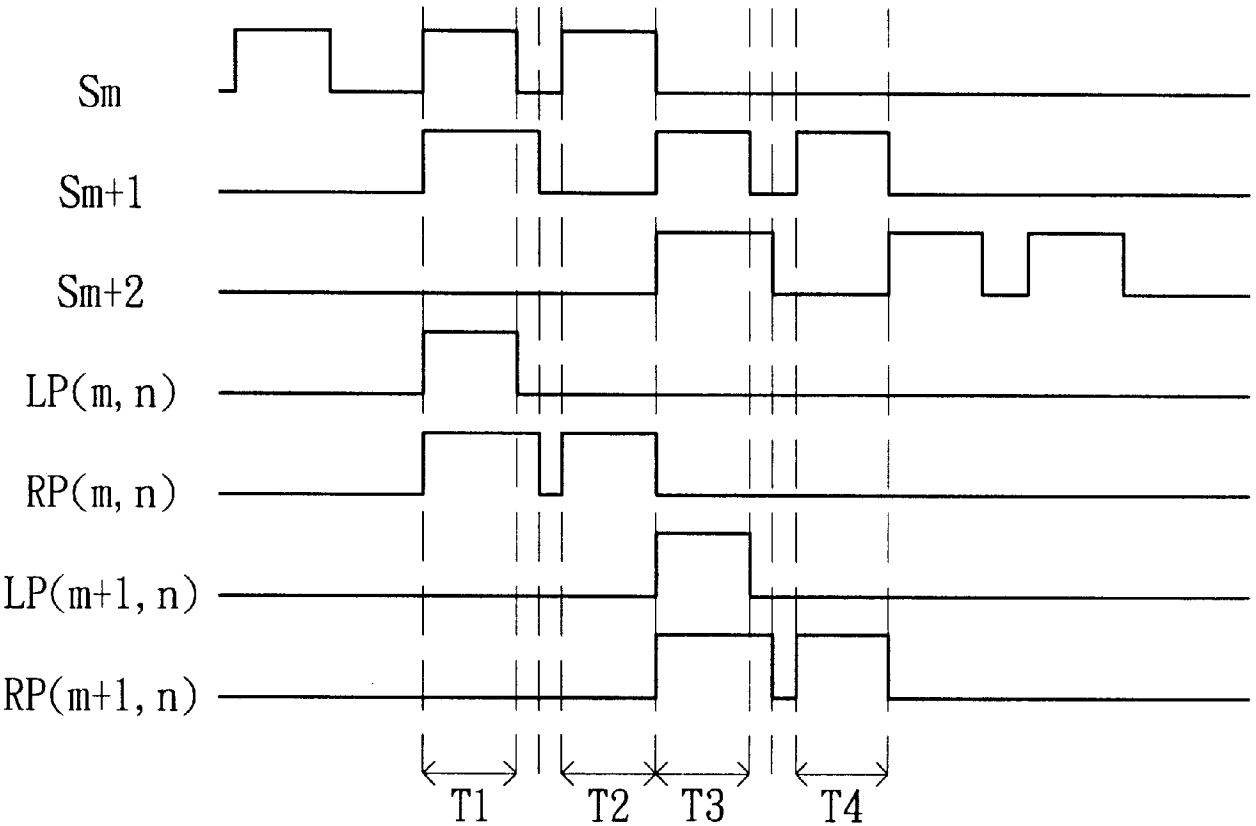
FIG. 6 shows a timing chart of the scan signals of the scan line $S_m$, $S_{m+1}$, and $S_{m+2}$ and the ON and OFF status of the corresponding pixels LP(m,n), RP(m,n), LP(m+1,n), and RP(m+1,n) shown in FIG. 5.

FIG. 6 shows the timing chart of the scan signals of the scan line $S_m$, $S_{m+1}$, and $S_{m+2}$ and the ON and OFF status of the corresponding pixels LP(m,n), RP(m,n), LP(m+1,n), and RP(m+1,n) shown in FIG. 5. The time domain multiplex driving method executed by the above-described time domain multiplex driving circuit is used for driving each pixel row in turn. The time domain multiplex driving method includes two scanning procedures. The first scanning procedure is used for turning ON the pixels that are respectively associated with two thin film transistors in the pixel row and then applying the corresponding data signals to these pixels respectively. The second scanning procedure is used for turning ON the pixels that are respectively associated with only one thin film transistor in the pixel row and then inputting the corresponding data signals into the pixels respectively.

Take pixels LP(m,n) and RP(m,n) shown in FIG. 5 as an example. In the time period T1, the first scanning procedure is executed so that the scan line $S_m$ and $S_{m+1}$ are enabled. The scan line $S_{m+1}$ is coupled to the gate electrode of the thin film transistor M11 (g11). In this manner, the thin film transistor M11 can be turned ON in the time period T1. Since the thin film transistor M11 is turned ON, the scan line $S_m$ is electrically coupled to the gate electrode of the thin film transistor M12 (g12). The scan signal of the scan line $S_m$ can be transmitted through the source electrode (s11) and the drain electrode (d11) of the thin film transistor M11 to the gate electrode of the thin film transistor M12 (g12). Therefore, the thin film transistor M12 can be turned ON. It should be noticed that the thin film transistor M12 cannot be turned ON unless the thin film transistor M11 is turned ON. In this manner, the corresponding data signal on the data line $D_n$ is inputted to the pixel LP(m,n) in the time period T1. After the data signals are inputted into the pixel LP(m,n), the scan line $S_m$ is disabled. The thin film transistor M11 can be turned OFF after the scan line $S_m$ is disabled. Then, the scan line $S_{m+1}$ is disabled. The thin film transistor M12 can be turned OFF after the scan line $S_{m+1}$ is disabled. In this manner, the first scanning procedure is accomplished.

In the time period T2, the second scanning procedure is executed, wherein the scan line $S_m$ is enabled again. The thin film transistor M2 is turned ON after the scan line $S_m$ is enabled. The corresponding data signal of the pixel RP(m,n) is inputted to the pixel RP(m,n) through the data line $D_n$ in the time period T2. After the data signal is inputted into the pixel RP(m,n), the scan line $S_m$ is to be disabled. In this manner, the second scanning procedure of the time domain multiplex driving method is accomplished.

It should be noticed that when the first scanning procedure is executed, the thin film transistor of the pixel RP(m,n), M2, can be turned ON as well as the thin film transistor M11 and M12 in the pixel LP(m,n). Thus, the data signal corresponded to the pixel LP(m,n) is inputted to the pixel RP(m,n) as well. When the second scanning procedure is executed, the thin film transistor of the pixel RP(m,n), M2, can still be turned ON and the data signal corresponded to the pixel RP(m,n) is inputted to the pixel RP(m,n) through the data line $D_n$. Besides, in the time period T2, the thin film transistor M12 of the pixel LP(m,n) cannot be turned ON since thin film transistor M11 of the pixel LP(m,n) is turned OFF, as shown in FIG. 6. Therefore, the data signal corresponded to the pixel RP(m,n) cannot be inputted to the pixel LP(m,n) in the time period T2. In this manner, after the first and the second scanning procedure are accomplished, the data signals corresponded to the pixels LP(m,n) and RP(m,n) are inputted to the corresponding pixels respectively.

The time domain multiplex driving circuit of the present invention has the following advantages. First, it takes less driving time to input all data signals into the corresponding pixels. Take the pixel LP(m,n) shown in FIG. 5 for example. Although the switching device of the pixel LP(m,n) includes two thin film transistors M11 and M12, the corresponding data signal can be inputted to the pixel LP(m,n) through the thin film transistor M12 only and then the pixel LP(m,n) substantially has an equivalent resistance equal to $R_o$. Compared with the pixel LP(m,n) shown in FIG. 3, the equivalent resistance of the pixel LP(m,n) shown in FIG. 5 is $R_o$ instead of $2R_o$. Therefore, it takes less driving time to input all data signals into the corresponding pixels.

Second, the degree of the feed-through effect and the difference between the output voltage and the input voltage of the thin film transistor is reduced. Take the pixel LP(m,n) shown in FIG. 5 for example. Although the switching device of the pixel LP(m,n) includes two thin film transistors M11 and M12, the corresponding data signal can be inputted to the pixel LP(m,n) through the thin film transistor M12 only. The equivalent capacitance of the pixel LP(m,n) of the embodiment is much smaller than that of the conventional time domain multiplex driving circuit. Therefore, the degree of the feed-through effect and the difference between the output voltage and the input voltage of the thin film transistor can be decreased.

Third, better display performance of the display panel is achieved. Take the pixels LP(m,n) and RP(m,n) shown in FIG. 5 for example. Since the data signal can be inputted to the pixel LP(m,n) through one thin film transistor M12 only, the capacitance of the equivalent capacitor of the pixel LP(m,n) is quite similar to that of the pixel RP(m,n). Therefore, the luminance of the pixel LP(m,n) can be more similar to that of the pixel RP(m,n) when the data signals fed into the pixels LP(m,n) and RP(m,n) are the same magnitude. If the switching device of each pixel in the same pixel column includes two thin film transistor and the switching device of each pixel in the adjacent column includes only one transistor, as shown in FIG. 5, the luminance of each pixel column can be more similar to that of the adjacent pixel column when the data signals of the same magnitude are inputted to these pixel columns. In this way, the odd-even line problem becomes insignificant. The display performance of the display panel can be improved.

Figure 7:
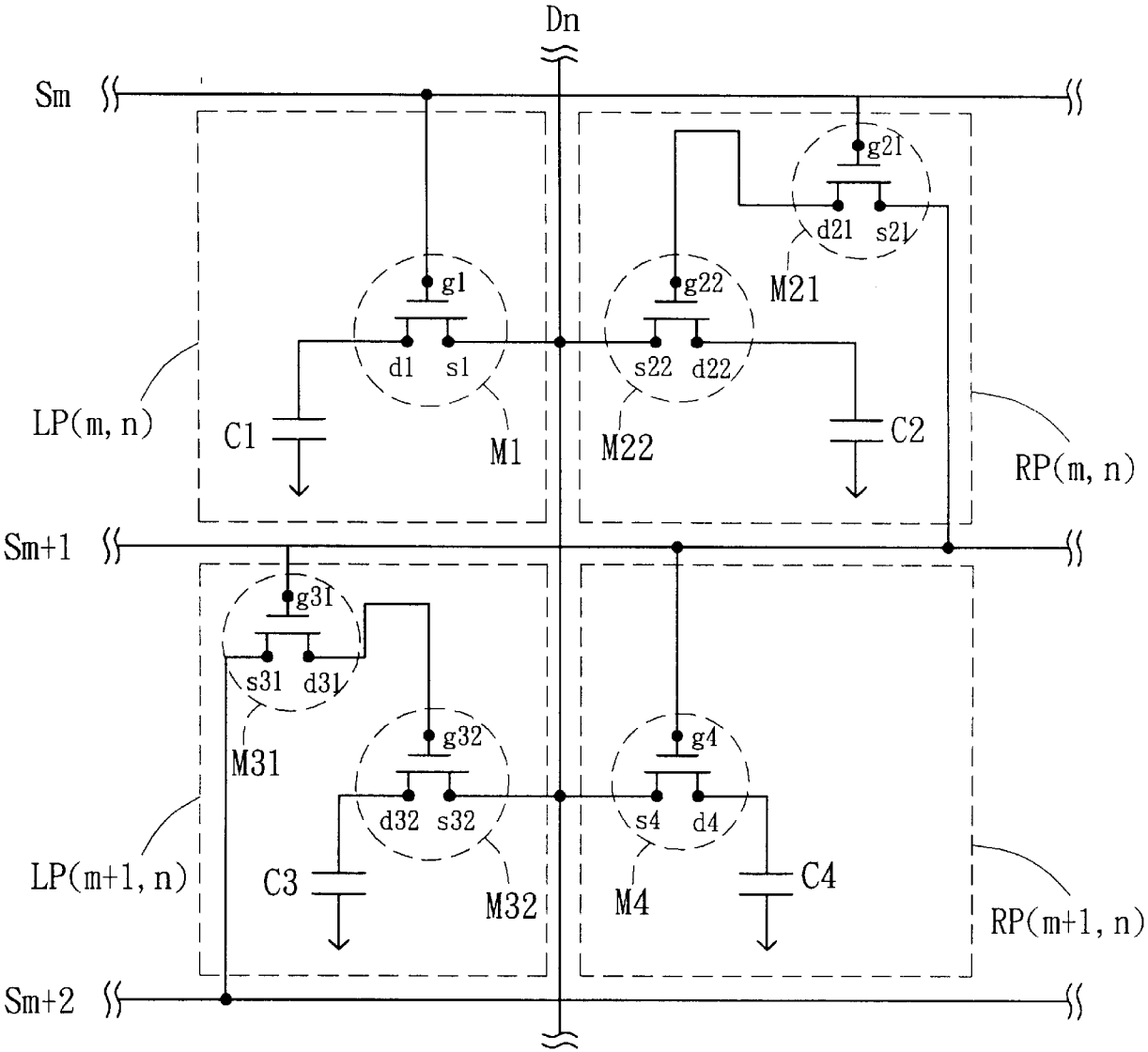
FIG. 7 shows a diagram of the time domain multiplex driving circuit according to a second embodiment of the present invention.

Second embodiment; FIG. 7 shows a diagram of the time domain multiplex driving circuit according to a second embodiment of the present invention. Take the pixel LP(m, n) and RP(m,n) shown in FIG. 7 for example; these two pixels are coupled to both the same scan line $S_m$ and the same data line $D_n$. The pixel LP(m,n) is set on the left side of the data line $D_n$ and the pixel RP(m,n) is set on the right side of the data line $D_n$, as shown in FIG. 7. The switching device of the pixel LP(m,n) includes a switch M1 which is used for selectively transmitting the data signal on the data line $D_n$ to the pixel LP(m,n). The switching device of the pixel RP(m,n) includes two switches M21 and M22 which are used for selectively transmitting the data signal on the data line $D_n$ to the pixel RP(m,n). It should be noticed that all the switches can be thin film transistors and the pixel with two switches can be set on the left side of the data line and the pixel with only one switch can then be set on the right side of the data line.

The switching device of the pixel LP(m,n) includes a thin film transistor M1. The gate electrode of the thin film transistor M1(g1) is coupled to the scan line $S_m$ and the source electrode of the thin film transistor M1 (s1) is coupled to the data line $D_n$. The switching device of the pixel RP(m,n) is different from that of the pixel LP(m,n). The switching device of the pixel RP(m,n) includes two thin film transistors M21 and M22. The gate electrode of the thin film transistor M21 (g21) is coupled to the scan line $S_m$, and the source electrode of the thin film transistor M21 (s21) is coupled to the scan line $S_{m+1}$. The source electrode of the thin film transistor M22 (s22) is coupled to the data line $D_n$ and the gate electrode of the thin film transistor M22 (g22) is coupled to the drain electrode of the thin film transistor M21 (d21), as shown in FIG. 7. It should be noticed that the coupling relation between the thin film transistors M21 and M22 of the pixel RP(m,n) shown in FIG. 7 is different than that of the thin film transistors M11 and M12 of the pixel LP(m,n) shown in FIG. 5.

The feature of the time domain multiplex driving circuit disclosed in the second embodiment is similar to that of the first embodiment of the present invention. Take the pixel RP(m,n) shown in FIG. 7 for example. The gate electrode of the thin film transistor M22 (g22) is coupled to the drain electrode of the thin film transistor M21 (d21). Therefore, the ON and OFF status of the thin film transistor M22 can be controlled by the thin film transistor M21. The thin film transistor M22 cannot be turned ON unless the thin film transistor M21 is turned ON.

Figure 8:
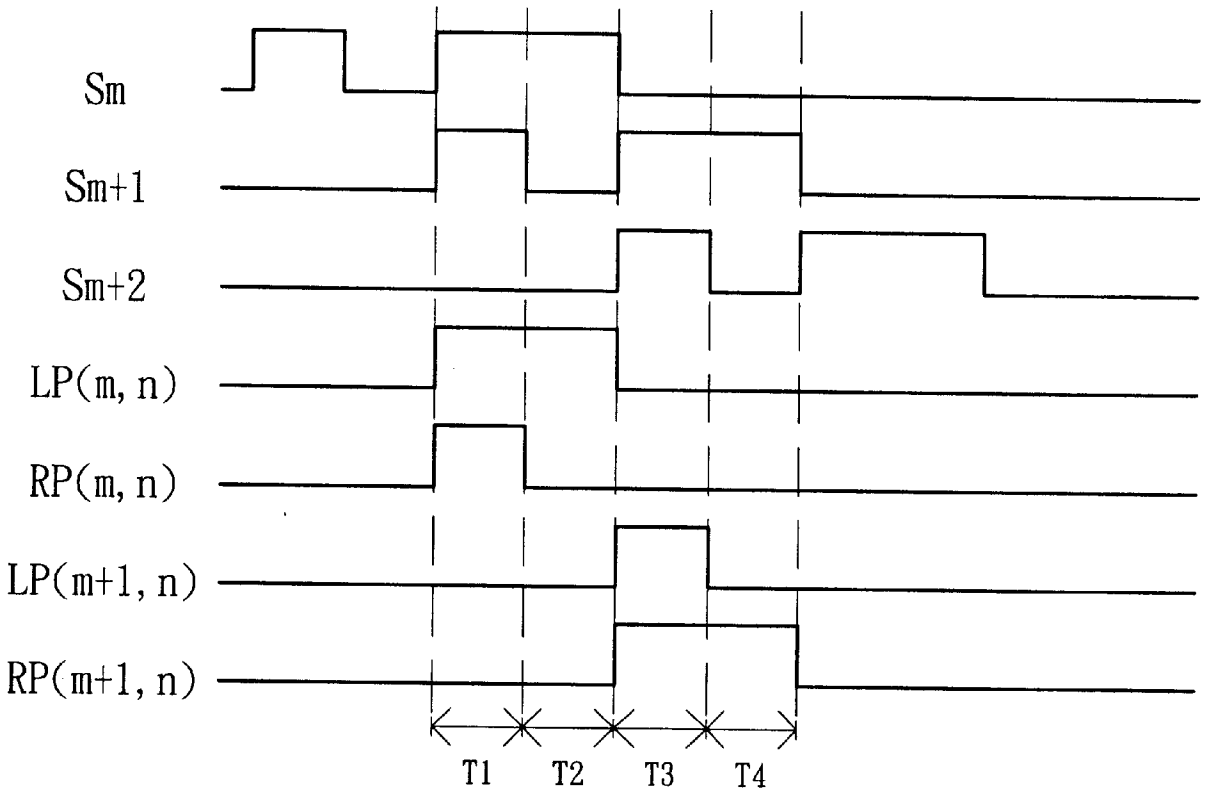
FIG. 8 shows a timing chart of the scan signals of the scan line $S_m$, $S_{m+1}$, and $S_{m+2}$ and the ON and OFF status of the corresponding pixels LP(m,n), RP(m,n), LP(m+1,n), and RP(m+1,n) shown in FIG. 7.

FIG. 8 shows a timing chart of the scan signals of the scan line $S_m$, $S_{m+1}$, and $S_{m+2}$ and the ON and OFF status of the corresponding pixels LP(m,n), RP(m,n), LP(m+1,n), and RP(m+1,n) shown in FIG. 7. The time domain multiplex driving method executed by the above-described time domain multiplex driving circuit includes two scanning procedures. The first scanning procedure is used for turning ON each pixel with two thin film transistors in the pixel row and then inputting the corresponding data signals into these pixels respectively. The second scanning procedure is used for turning ON each pixel with only one thin film transistor in the pixel row and then inputting the corresponding data signals into the pixels respectively Take pixels LP(m,n) and RP(m,n) shown in FIG. 7 for example. In the time period T1, the first scanning procedure is executed, and the scan line $S_m$ and $S_{m+1}$ are enabled. The scan line $S_m$ is coupled to the gate electrode of the thin film transistor M21 (g21). In this manner, the thin film transistor M21 can be turned ON. When the thin film transistor M21 is turned ON, the scan line $S_{m+}1$ is electrically coupled to the gate electrode of the thin film transistor M22 (g22). Therefore, the corresponding scan signal of the scan line $S_{m+1}$ can be transmitted to the gate electrode of the thin film transistor M22 through the source electrode (s21) and the drain electrode (d21) of the thin film transistor M21. Therefore, the thin film transistor M22 can be turned ON. It should be noticed that the thin film transistor M22 cannot be turned ON unless the thin film transistor M21 is turned ON. In this manner, the data signal corresponded to the pixel RP(m,n) can be inputted to the pixel RP(m,n) through the data line $D_n$ in the time period T1. After inputting the data signals into the pixel LP(m,n), the scan line $S_{m+1}$ will be disabled. The thin film transistor M22 can be turned OFF after the scan line $S_{m+1}$ is disabled. Besides, the scan line $S_m$ is still enabled in the end of the time period T1. In this manner, the first scanning procedure is accomplished.

In the time period T2, the second scanning procedure is executed. Since the scan line $S_m$ is still enabled and the gate electrode of the thin film transistor M1 (g1) is coupled to the scan line $S_m$, the thin film transistor M1 can be turned ON. The corresponding data signal can be inputted to the pixel LP(m,n) through the data line $D_n$ in the time period T2. After the data signal is inputed to the pixel LP(m,n), the scan line $S_m$ can be disabled. In this manner, the second scanning procedure of the time domain multiplex driving method is accomplished.

It should be noticed that when the first scanning procedure is executed, the thin film transistor of the pixel LP(m,n), M1 as well as the thin film transistor M21 and M22 in the pixel RP(m,n) can be turned ON. The data signal corresponded to the pixel RP(m,n) is inputted to the pixel LP(m,n) in the time period T1. But when the second scanning procedure is executed, the thin film transistor of the pixel LP(m,n), M1, is still turned ON and the data signal corresponded to the pixel LP(m,n) is inputted to the pixel LP(m,n) through the data line $D_n$ in this time period T2. Besides, in the time period T2, the thin film transistor M22 of the pixel RP(m,n)

cannot be turned ON since thin film transistor M21 of the pixel RP(m,n) has been turned OFF, as shown in FIG. 8. Therefore, the data signal corresponded to the pixel LP(m,n) cannot be to the pixel RP(m,n) in the time period T2. In this manner, after the first and the second scanning procedures are accomplished, the data signals corresponded to the pixels LP(m,n) and RP(m,n) are inputted to the corresponding pixels respectively.

The advantages of the time domain multiplex driving circuit disclosed in the second embodiment are similar to that of the first embodiment of the present invention. First, it takes less driving time to input all data signals into the corresponding pixels. Second, the degree of the feed-through effect and the difference between the output voltage and the input voltage of the thin film transistor is decreased. Third, the difference between the luminance of the pixel LP(m,n) and that of the pixel RP(m,n) is insignificant when the data signals of the same magnitude are fed to the pixels LP(m,n) and RP(m,n), the odd-even line problem cannot happen, and the display performance of the display panel can be improved.

Figure 9:
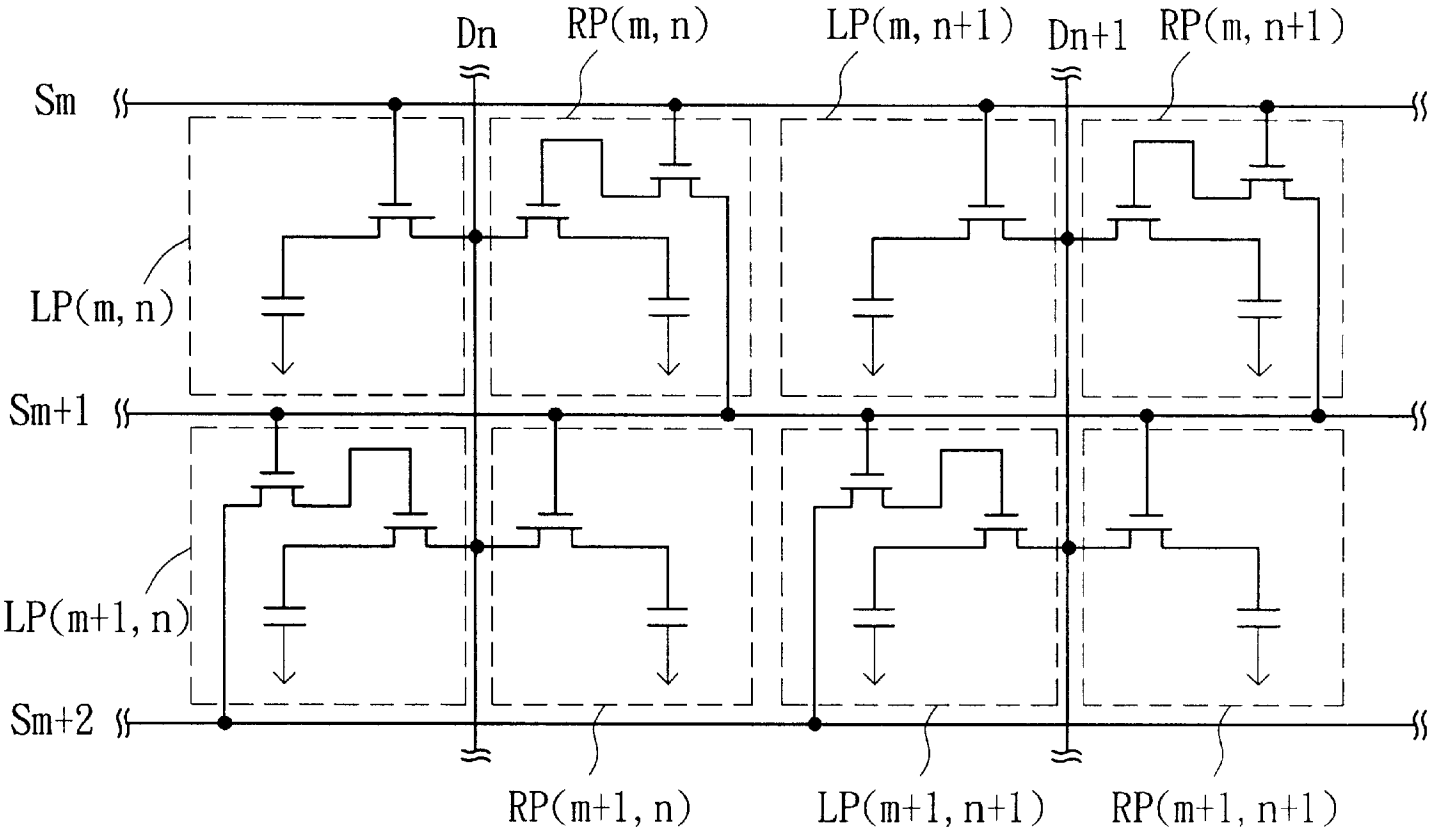
FIG. 9 shows the first mirror image form of the time domain multiplex driving circuit according to the present invention.
Figure 10:
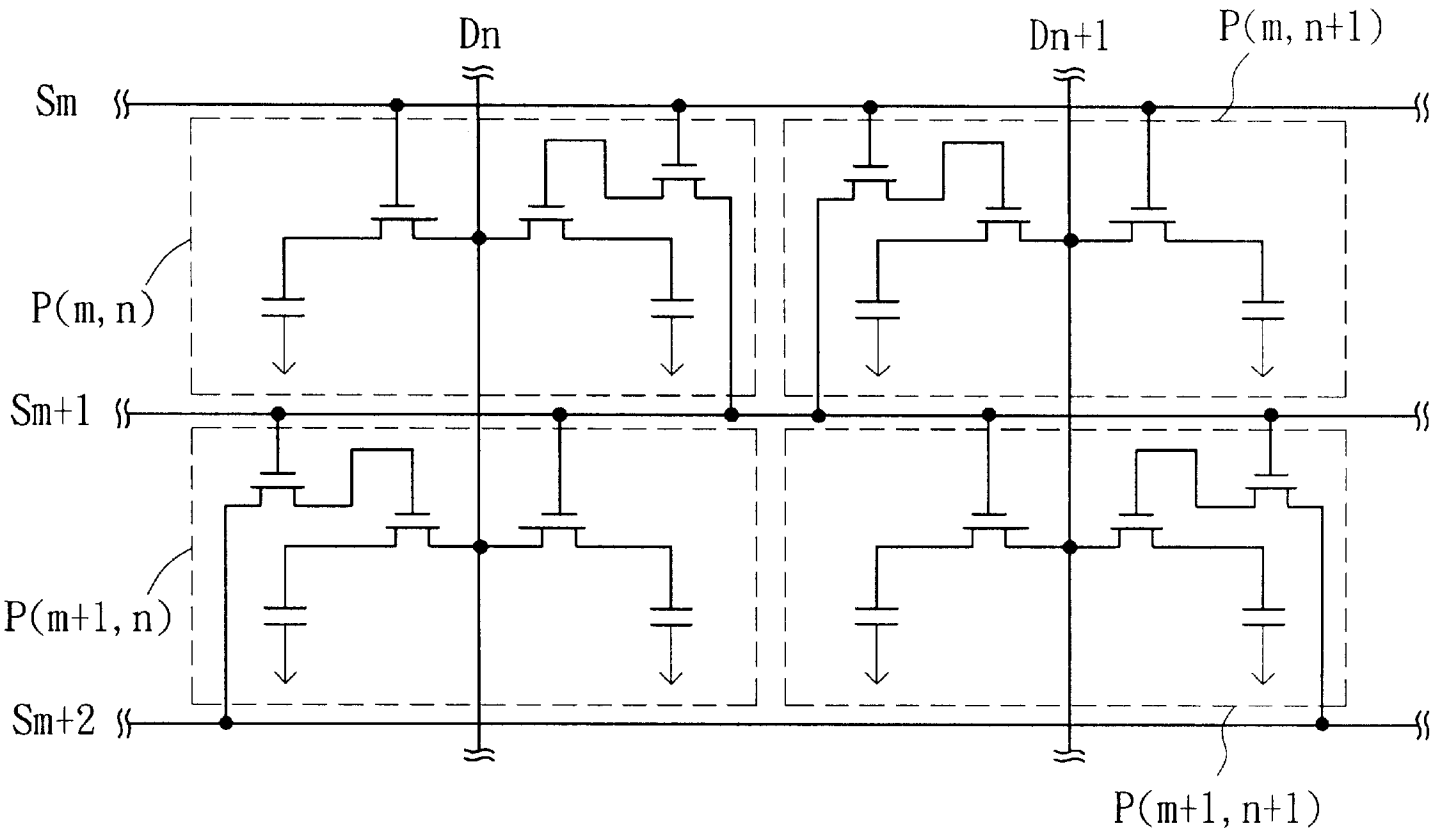
FIG. 10 shows the second mirror image form of the time domain multiplex driving circuit according to the present invention.

The pixels coupled to both the same scan line and the same data line form a pixel group. For example, the pixels LP(m,n) and RP(m,n) shown in FIG. 7 are coupled to both the scan line $S_m$ and the data line $D_n$. These two pixels can be viewed as a pixel group P(m,n). Similarly, the pixels LP(m+1,n) and RP(m+1,n) forms a pixel group P(m+1,n). In FIG. 7, the switching device of the pixel LP(m,n) is the same as that of the pixel RP(m+1,n), and the switching device of the pixel RP(m,n) is the same as that of the pixel LP(m+1,n). Therefore, the pixel group P(m+1,n) is a horizontal mirror image of and P(m,n). FIG. 9 is a first mirror-image configuration of a time domain multiplex driving circuit according to the present invention. In FIG. 9, each pixel group coupled to one data line is the horizontal mirror image of the adjacent pixel group coupled to the same data line. FIG. 10 shows a second mirror-image configuration of a time domain multiplex driving circuit according to the present invention. In FIG. 10, the pixel group P(m,n) is the same as the pixel group P(m+1,n+1) while the pixel group P(m,n+1) is the same as the pixel group P(m+1,n). Therefore, all pixels of the same pixel column are not the same and all pixels of the same pixel row are not the same, either. In this manner, the odd-even line problem can be further improved.

The best mode of the display apparatus with the time domain multiplex driving circuit in accordance with the invention has the following advantages. First, a reduced number of the data lines are required. Therefore, the pitch between the adjacent data lines can be increased. It is easier to connect all data lines to the corresponding outer leads of the tape carrier packages. Besides, since the number of the data line is decreased, the aperture ratio of the display panel is increased. Second, the equivalent resistance of the pixel can be decreased when the data signal is inputted to the corresponding pixel. Therefore, it takes less driving time to input all data signals into the corresponding pixels. Third, the luminance of the pixel with two thin film transistors is similar to that of the pixel with only one thin film transistor when the data signals of the same magnitude are inputted to these two kinds of pixels. Fourth, the odd-even line problem can be improved. If the pixels are set in the mirror image form, the odd-even problem can be further improved.

While the invention has been described by way of example and in terms of the preferred embodiment, it is to be understood that the invention is not limited to the disclosed embodiment. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display apparatus comprising:

a first scan line arranged in a first direction;

a second scan line parallel with the first scan line;

a first data line arranged in a second direction, wherein the second direction is perpendicular to the first direction;

a first pixel coupled to the first data line, the first scan line and the second scan line respectively;

a second pixel coupled to the first data line and the first scan line respectively;

a first switching device in the first pixel for selectively transmitting a first data signal on the first data line to the first pixel, wherein the first switching device includes a first switch and a second switch and the first switch is controlled by the second switch; and a second switching device in the second pixel for selectively transmitting a second data signal on the first data line to the second pixel, wherein the second switching device includes a third switch.

2. The display apparatus according to claim 1, wherein the first switch, the second switch, and the third switch are thin film transistors (TFT).

3. The display apparatus according to claim 2, the first switch includes a gate electrode, a first source/drain electrode, and a second source/drain electrode, wherein the first source/drain electrode is coupled to the first data line and the gate electrode is coupled to the second switch.

4. The display apparatus according to claim 2, the third switch includes a gate electrode, a first source/drain electrode, and a second source/drain electrode, wherein the first source/drain electrode is coupled to the first data line and the gate electrode is coupled to the first scan line.

5. The display apparatus according to claim 2, the second switch includes a gate electrode, a first source/drain electrode, and a second source/drain electrode, wherein the first source/drain electrode is coupled to the first switch.

6. The display apparatus according to claim 5, wherein the second source/drain electrode is coupled to the first scan line and the gate electrode is coupled to the second scan line.

7. The display apparatus according to claim 6, wherein the method for driving the time domain multiplex driving circuit comprising:

enabling the first scan line and the second scan line;

inputting the first data signal to the first data line;

disabling the first scan line;

disabling the second scan line;

enabling the first scan line again;

inputting the second data signal to the first data line; and disabling the first scan line;

wherein the first data signal is to be inputted to the first pixel and the second data signal is to be inputted to the second pixel.

8. The display apparatus according to claim 5, wherein the second source/drain electrode is coupled to the second scan line and the gate electrode is coupled to the first scan line.

9. The display apparatus according to claim 8, wherein the method for driving the time domain multiplex driving circuit comprising:

enabling the first scan line and the second scan line;

inputting the first data signal to the first data line;

disabling the second scan line;

inputting the second data signal to the first data line; and disabling the first scan line;

wherein the first data signal is to be inputted to the first pixel and the second data signal is to be inputted to the second pixel.

10. The display apparatus according to claim 1, wherein the display apparatus is a liquid crystal display (LCD).

11. A display apparatus comprising:

a first scan line arranged in a first direction;

a second scan line parallel with the first scan line;

a third scan line parallel with the first scan line and the second scan line;

a first data line arranged in a second direction, wherein the second direction is perpendicular to the first direction;

a first pixel coupled to the first data line, the first scan line and the second scan line respectively;

a second pixel coupled to the first data line and the first scan line respectively;

a third pixel coupled to the first data line and the second scan line respectively; and a fourth pixel coupled to the first data line, the second scan line and the third scan line respectively, wherein the first pixel and the third pixel are on the same side of the first data line and the second pixel and the fourth pixel are on the other side of the first data line.

12. The display apparatus according to claim 11, wherein the display apparatus further comprising:

a first switching device in the first pixel for selectively transmitting a first data signal from the first data line to the first pixel, wherein the first switching device includes a first switch and a second switch and the first switch is controlled by the second switch;

a second switching device in the second pixel for selectively transmitting a second data signal from the first data line to the second pixel, wherein the second switching device includes a third switch;

a third switching device in the third pixel for selectively transmitting a third data signal from the first data line to the third pixel, wherein the third switching device includes a fourth switch; and a fourth switching device in the fourth pixel for selectively transmitting a fourth data signal from the first data line to the fourth pixel, wherein the fourth switching device includes a fifth switch and a sixth switch, and the fifth switch is controlled by the sixth switch.

13. The display apparatus according to claim 12, wherein the first switch, the second switch, the third switch, the fourth switch, the fifth switch, and the sixth switch are thin film transistors (TFT).

14. The display apparatus according to claim 13, the first switch includes a gate electrode, a first source/drain electrode, and a second source/drain electrode, wherein the first source/drain electrode is coupled to the first data line and the gate electrode is coupled to the second switch.

15. The display apparatus according to claim 13, the third switch includes a gate electrode, a first source/drain electrode, and a second source/drain electrode, wherein the first source/drain electrode is coupled to the first data line and the gate electrode is coupled to the first scan line.

16. The display apparatus according to claim 13, the fourth switch includes a gate electrode, a first source/drain electrode, and a second source/drain electrode, wherein the first source/drain electrode is coupled to the first data line and the gate electrode is coupled to the second scan line.

17. The display apparatus according to claim 13, the fifth switch further includes a gate electrode, a first source/drain electrode, and a second source/drain electrode, wherein the first source/drain electrode is coupled to the first data line and the gate electrode is coupled to the sixth switch.

18. The display apparatus according to claim 13, the second switch includes a gate electrode, a first source/drain electrode, and a second source/drain electrode, wherein the first source/drain electrode is coupled to the first switch.

19. The display apparatus according to claim 18, the sixth switch includes a gate electrode, a first source/drain electrode, and a second source/drain electrode, wherein and the first source/drain electrode is coupled to the fifth switch.

20. The display apparatus according to claim 19, wherein the second source/drain electrode of the second switch is coupled to the first scan line and the gate electrode of the second electrode is coupled to the second scan line.

21. The display apparatus according to claim 20, wherein the second source/drain electrode of the sixth switch is coupled to the second scan line and the gate electrode of the sixth electrode is coupled to the third scan line.

22. The display apparatus according to claim 21, wherein the method for driving the time domain multiplex driving circuit comprising:

enabling the first scan line and the second scan line;

inputting the first data signal to the first data line;

disabling the first scan line;

disabling the second scan line;

enabling the first scan line again;

inputting the second data signal to the first data line;

disabling the first scan line;

enabling the second scan line and the third scan line;

inputting the third data signal to the first data line;

disabling the second scan line;

disabling the third scan line;

enabling the second scan line again;

inputting the fourth data signal to the first data line; and disabling the second scan line;

wherein the first data signal is to be inputted to the first pixel, the second data signal is to be inputted to the second pixel, the third data signal is to be inputted to the fourth pixel, the fourth data signal is to be inputted to the third pixel.

23. The display apparatus according to claim 19, wherein the second source/drain electrode of the second switch is coupled to the second scan line and the gate electrode of the second electrode is coupled to the first scan line.

24. The display apparatus according to claim 23, wherein the second source/drain electrode of the sixth switch is coupled to the third scan line and the gate electrode of the sixth electrode is coupled to the second scan line.

25. The display apparatus according to claim 24, wherein the method for driving the time domain multiplex driving circuit comprising:

enabling the first scan line and the second scan line;

inputting the first data signal to the first data line;

disabling the second scan line;

inputting the second data signal to the first data line;

disabling the first scan line;

enabling the second scan line and the third scan line;

inputting the third data signal to the first data line;

disabling the third scan line;

inputting the fourth data signal to the first data line; and disabling the second scan line;

wherein the first data signal is to be inputted to the first pixel, the second data signal is to be inputted to the second pixel, the third data signal is to be inputted to the fourth pixel, the fourth data signal is to be inputted to the third pixel.

26. The display apparatus according to claim 11, wherein the display apparatus is a liquid crystal display (LCD).

* * * * *